United States Patent [19]

Kugel et al.

[11] 4,396,397

[45] Aug. 2, 1983

[54] METHOD OF STABILIZATION OF COAL FUEL OIL MIXTURE

[75] Inventors: Roger W. Kugel, Winona, Minn.; George T. Kekish, Naperville, Ill.

[73] Assignee: Nalco Chemical Company, Oak Brook, Ill.

[21] Appl. No.: 399,668

[22] Filed: Jul. 19, 1982

[51] Int. Cl.[3] ..... C10L 1/32

[52] U.S. Cl. ..... 44/51; 44/60; 44/70; 406/49

[58] Field of Search ..... 44/51, 60, 70

[56] References Cited

U.S. PATENT DOCUMENTS 3,036,901 5/1962 Sanders, Jr. et al. ..... 44/60

3,111,381 11/1963 Panzer et al. ..... 44/51

*Primary Examiner*—Charles F. Warren

*Assistant Examiner*—Margaret B. Medley

*Attorney, Agent, or Firm*—John G. Premo; Robert A. Miller

[57] ABSTRACT

A stable coal fuel oil mixture which comprises a major portion of fuel oil a minor portion of pulverized coal and from about 0.5-3% by weight of calcium acetate.

2 Claims, No Drawings

METHOD OF STABILIZATION OF COAL FUEL OIL MIXTURE

INTRODUCTION

Mixtures of particulate coal and petroleum oil have been employed in the past as fuel for boilers, steel mill blast furnaces and the like; and much of the early development work on these mixtures involved schemes for utilizing substandard coal and fines. Recently, the desire for more efficient use of domestic energy reserves has led to renewed efforts to optimize the utility of slurries of pulverized coal and petroleum liquids for fuel purposes.

It is well known that simple mixtures of finely crushed coal and petroleum oil ordinarily exhibit undesirable particle settling, agglomeration and compaction; and the hard sediments which utlimately result tend to resist redispersion and consequently render the mixture unusable. Continuous mechanical agitation has been practiced heretofore as a means of preventing coal sedimentation. However, sedimentation and compaction can occur, even in agitated systems, whenever quiescent regions occur, such as adjacent corners and near flow-control valves. Reducing the coal to micron size in order to promote suspension has likewise been proposed, but this approach has proved to be unacceptably expensive.

Various chemical additives have also been developed in the past for stabilizing a suspension of coal macroparticles in a petroleum liquid co-fuel; and many of these additives act through thixotropicity or through the creation of micelles in the fluid medium. Regardless of such chemical advances in resisting sedimentation, coal and oil mixtures continue to exhibit various commercial deficiencies, notably among them being the propensity to produce air pollution upon combustion.

SUMMARY OF THE INVENTION

A stable coal fuel oil mixture which comprises a major portion of fuel oil a minor portion of pulverized coal and from about 0.1–5% by weight of calcium acetate.

In a preferred embodiment of the invention the calcium acetate additives is formed in situ in the coal fuel oil mixture. Thus calcium compounds as calcium oxide, calcium hydroxide, calcium carbonate and the like may be reacted with amounts of acetic acid to form the additives of the invention.

One of the advantages of the invention is that the calcium portion of the calcium acetate can provide slag modification and a reduction in the $SO_x$ emission characteristics of the fuel so treated.

The coal fuel oil mixture used in the invention may contain from between 50–60% by weight of a fuel oil and with the balance being pulverized coal having an average size finer than 100 mesh. In most cases the majority of the coal will be finer than 200 mesh. The amount of calcium acetate required to obtain improved stability of the coal fuel oil mixtures may vary between 0.1%–5% by weight of the coal oil fuel mixture. A preferred dosage range is 0.3–3%.

To illustrate the advantage of the invention the following composition was prepared:

| | |
|---|---|
| 66.28% | #6 fuel oil |
| 30.00% | pulverized coal (80%–200% mesh) |
| 3.00% | $CaCO_3$ (pulverized) |
| 0.72% | $CH_3COOH$ |

The calcium carbonate was first added and then the acetic acid to form the calcium acetate in situ.

This composition had a high rest viscosity of about 20,000 cps and a low shear thinned viscosity of 600 cps at 60°.

I claim:

1. A stable coal fuel oil mixture which comprises a major portion of fuel oil a minor portion of pulverized coal and from about 0.1–5% by weight of calcium acetate.

2. The stable coal fuel oil mixture of claim 1 characterized in that the calcium acetate is forming in situ by reacting a calcium coating compound with acetic acid in the presence of the oil coal mixture.

* * * * *